United States Patent [19]

Bobb et al.

[11] Patent Number: 4,636,021

[45] Date of Patent: Jan. 13, 1987

[54] HIGH DENSITY ZIF CARD EDGE CONNECTOR

[75] Inventors: Clifford F. Bobb, Carlisle; Robert F. Cobaugh, Elizabethtown, both of Pa.

[73] Assignee: AMP Incorporated, Harrisburg, Pa.

[21] Appl. No.: 785,110

[22] Filed: Oct. 7, 1985

Related U.S. Application Data

[63] Continuation of Ser. No. 585,013, Mar. 2, 1984, abandoned, which is a continuation of Ser. No. 394,235, Jul. 1, 1982, abandoned, which is a continuation-in-part of Ser. No. 297,431, Aug. 28, 1981, abandoned.

[51] Int. Cl.[4] ..... H01R 9/09

[52] U.S. Cl. ..... 339/75 MP; 339/176 MP

[58] Field of Search ..... 339/74 R, 75 MP, 176 MP

[56] References Cited

U.S. PATENT DOCUMENTS

| | | | |
|---|---|---|---|
| 3,399,372 | 8/1968 | Uberbacher | 339/176 MP |
| 3,660,803 | 5/1972 | Cooney | 339/17 LM |
| 3,697,929 | 10/1972 | Konewko et al. | 339/75 MP |
| 3,793,609 | 2/1974 | McIver | 339/74 R |
| 3,899,234 | 8/1975 | Yeager et al. | 339/75 MP |
| 3,963,317 | 6/1976 | Eigenbrode et al. | 339/74 R |
| 4,021,091 | 5/1977 | Anhalt et al. | 339/75 MP |
| 4,159,861 | 7/1979 | Anhalt | 339/75 MP |
| 4,179,177 | 12/1979 | Lapraik | 339/74 R |
| 4,303,294 | 12/1981 | Hamsher, Jr. et al. | 339/74 R |
| 4,343,523 | 8/1982 | Cairns et al. | 339/176 MP X |

FOREIGN PATENT DOCUMENTS

| | | | |
|---|---|---|---|
| 2341770 | 2/1975 | Fed. Rep. of Germany | 339/176 MP |

OTHER PUBLICATIONS

IBM Technical Disclosure Bulletin, vol. 14, No. 9, pp. 2597–2598, Colletti et al., Twin-Contact Connector.

Abandoned U.S. patent application Ser. No. 294,431, filed Aug. 28, 1981, by Andrews et al.

Abandoned U.S. patent application Ser. No. 244,185, filed Mar. 16, 1981 by Cobaugh et al.

Preliminary Invention Disclosure No. 4973, dated Jul. 12, 1978 by Robert Cobaugh and Attalee Taylor.

*Primary Examiner*—John McQuade

*Attorney, Agent, or Firm*—Allan B. Osborne

[57] ABSTRACT

The present invention relates to a card edge connector having means so that a circuit card may be freely inserted into and withdrawn therefrom. The connector includes an upper housing slidably mounted on cam means so that upon the upper housing being slid vertically upwardly, contact elements extending upwardly thereinto are forced into the card receiving slot and against a card which may be positioned therein.

27 Claims, 9 Drawing Figures

HIGH DENSITY ZIF CARD EDGE CONNECTOR

This application is a continuation of application Ser. No. 585,013, filed Mar. 2, 1984, which is a continuation of application Ser. No. 394,235 filed July 1, 1982, which is a continuation-in-part of application Ser. No. 297,431, filed Aug. 28, 1981, all of which are now abandoned.

U.S. Pat. No. 3,660,803 discloses and describes a card edge connector having twice the number of contact elements than normally contained in other contemporary card edge connectors. The increased density is achieved by positioning the lower portion of each second element behind the lower portion of each first element and displacing the upper portion of each second element laterally and forwardly so as to position it adjacent the upper portion of each first element.

U.S. Pat. No. 3,899,234 discloses and describes a card edge connector having a U-shaped driving member vertically movably positioned in the bottom of the card edgereceiving slot. Upon camming the driving member upwardly, its parallel side walls engage and displace the contact elements which are otherwise resiliently extended into the slot. After the card is placed into the slot from above, the driving member is returned to its original position so that the contact elements may spring back into the slot to electrically engage the conductive traces on the card.

U.S. Pat. No. 3,982,807 discloses and describes a card edge connector comprising a lower mounting member containing contact elements and a vertically sliding housing positioned thereover. A rotating shaft drives the housing down so that camming surfaces therein push the contact elements into electrical engagement with a card which may be positioned in the card edge receiving slot.

The present invention is intended to provide a connector having a high density of contact elements such as disclosed in U.S. Pat. No. 3,660,803 and further being able to receive a card without an insertion force thereon being required. More particularly, the connector includes a plurality of contact elements positioned in a lower housing and having contact surfaces extending upwardly into compartments located along both sides of a card edge receiving slot in an upper housing movably mounted on the lower housing. Camming means positioned between the lower and upper housing move the upper housing upwardly whereby camming surfaces therein cam the contact elements in towards the slot to engage conductive traces on a card which may be positioned therein. Further, the upper housing includes upwardly converging outer side walls to accept an electrostatic shield.

For a better understanding of the invention, reference will now be made by way of example to the accompanying drawings, in which.

Figure 1:
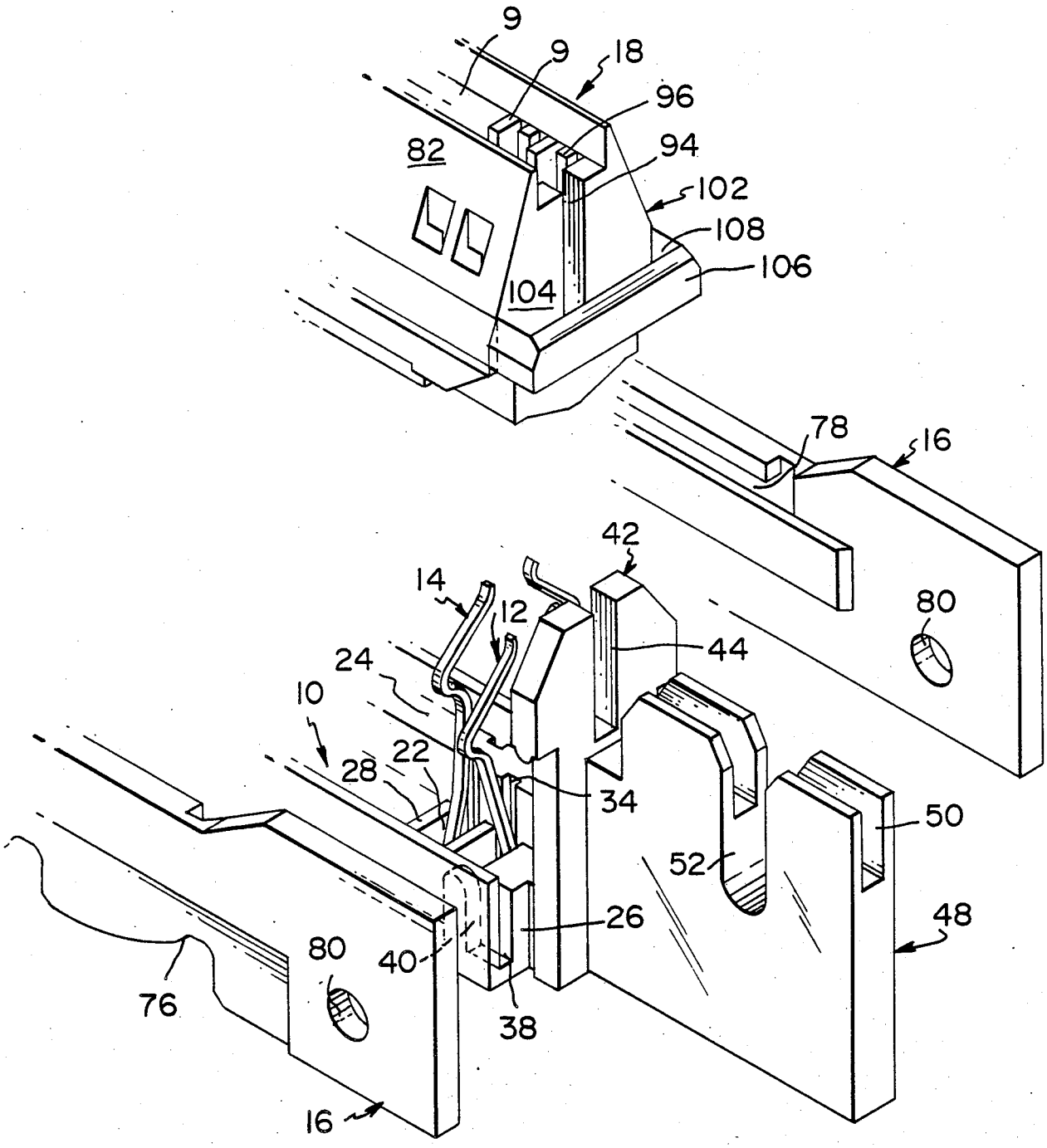
FIG. 1 is a perspective view of the several components of the connector of the present invention, shown in exploded fashion.
Figure 5:
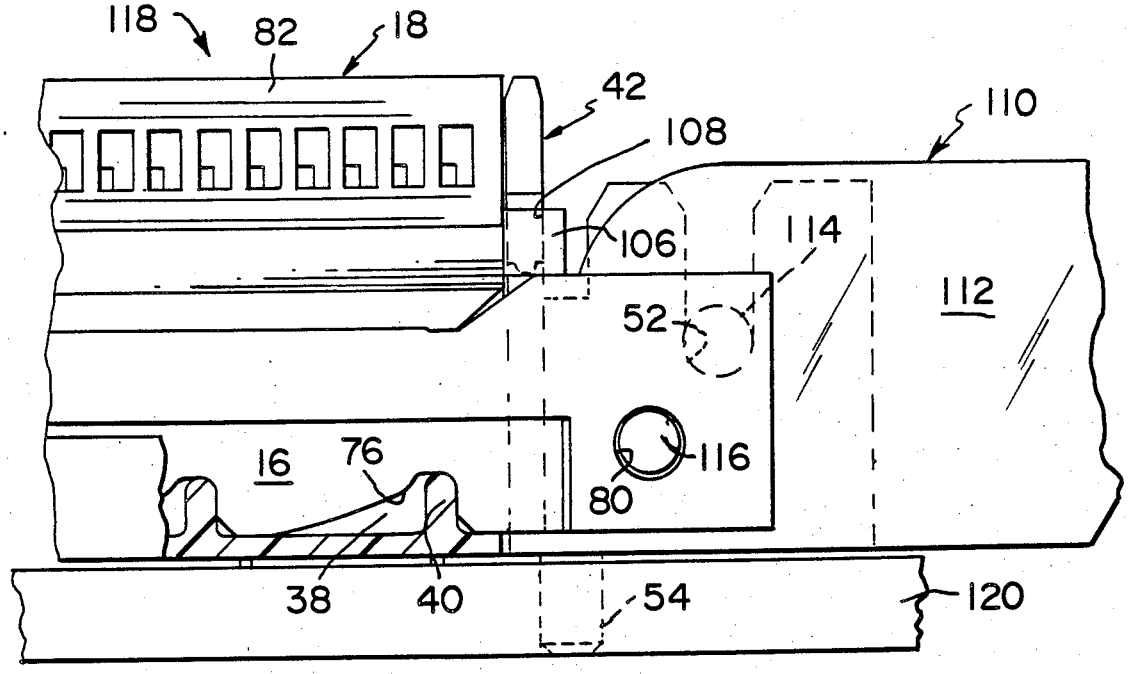
Figures 3A, 3B, 4A, 4B:
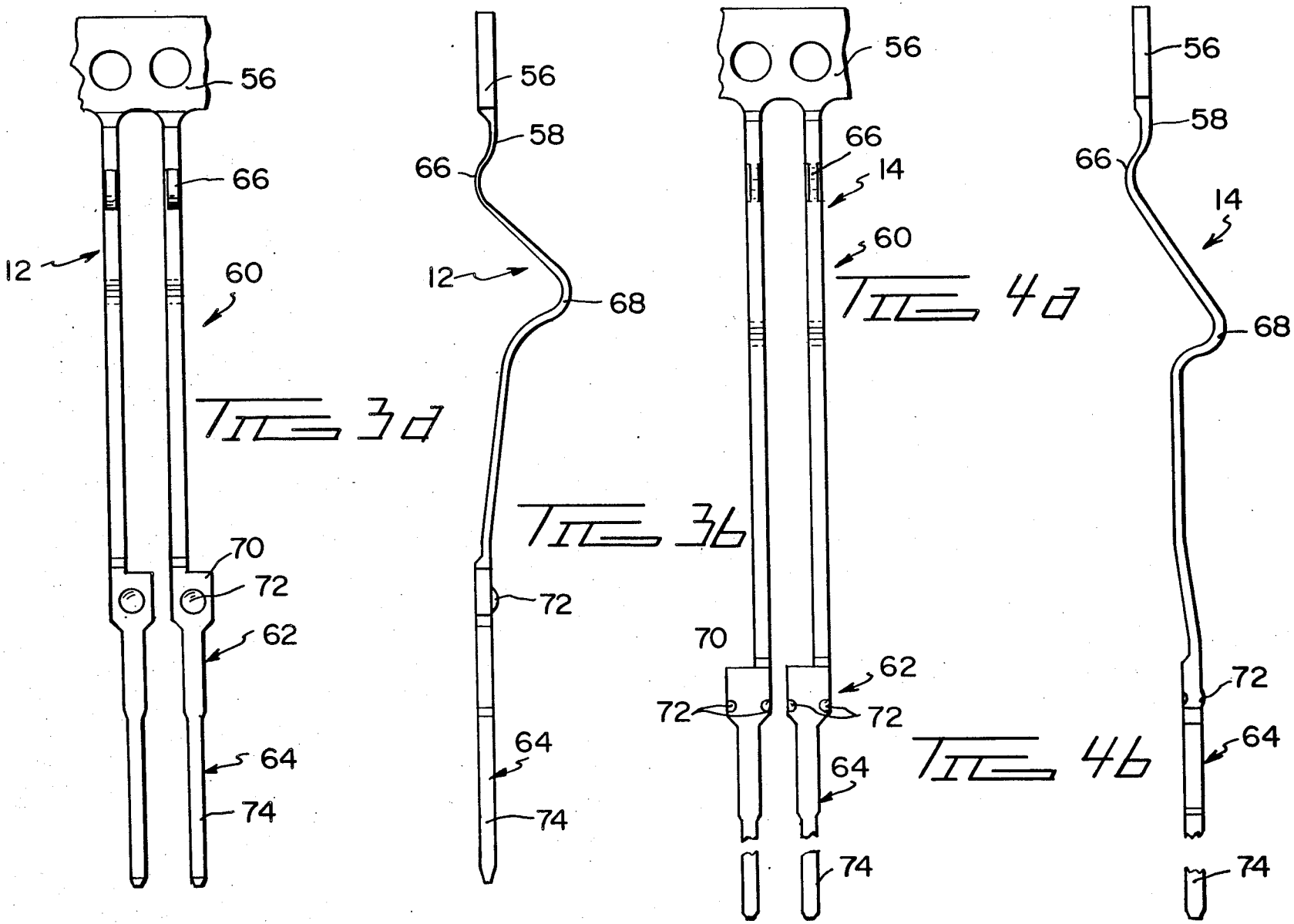

FIG. 3-*a*, 3-*b*, 4-*a* and 4-*b* are views of the contact elements of the connector of FIG. 1;

FIG. 5 is a side view showing the camming mechanism and structure; and

Figure 6:
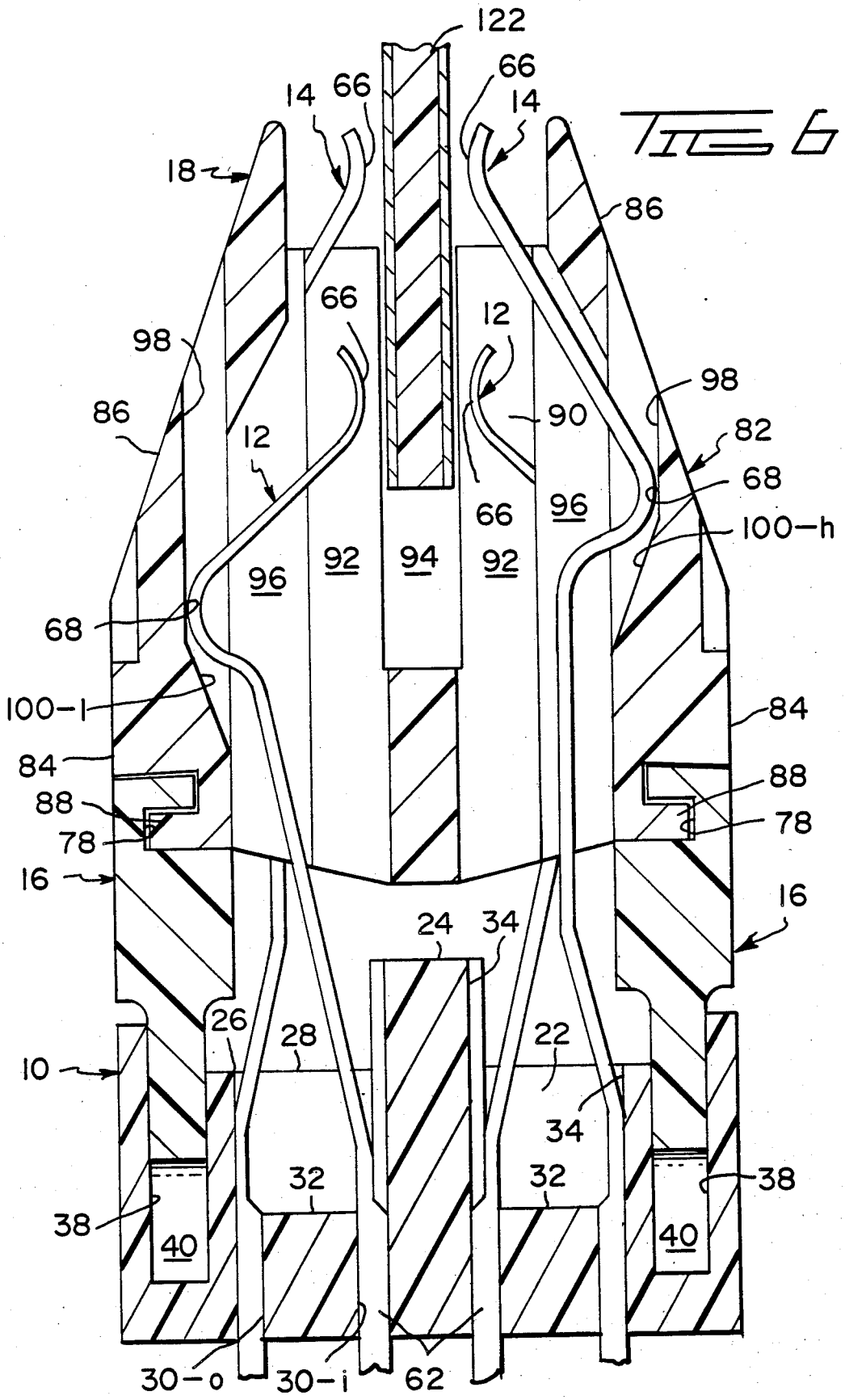
Figure 7:
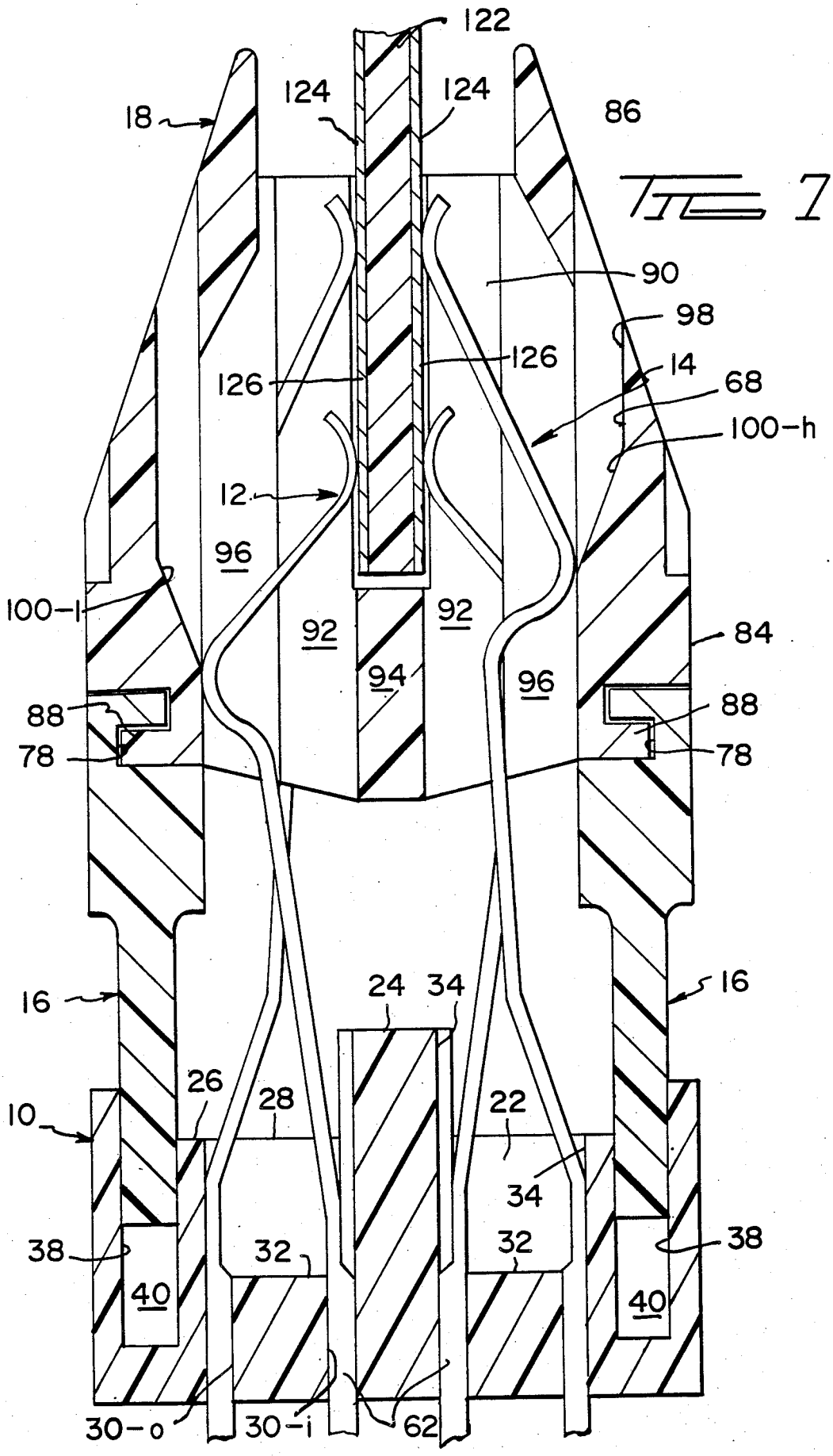

FIGS. 6 and 7 are cross-sectional views looking axially into the connector to illustrate the operation thereof.

With specific reference to FIG. 1, the components of the connector of the present invention include a lower housing 10, contact elements 12 and 14, cam slides 16 and upper housing 18. These several components, along with lever 110 shown in FIG. 5, are structured and assembled to provide a card edge connector having a high density of contact elements. These elements are cammed into electrical engagement with the conductive traces on a circuit card after it has been inserted into the card-receiving slot in the connector. The housings and camming means are made from a suitable insulative material such as a glass-filled plastic sold by the General Electric Company under the trade name VALOX. The contact elements are preferrably stamped and formed on continuous strip with the preferred material being phosphor bronze and plated with gold over nickel.

Figure 2:
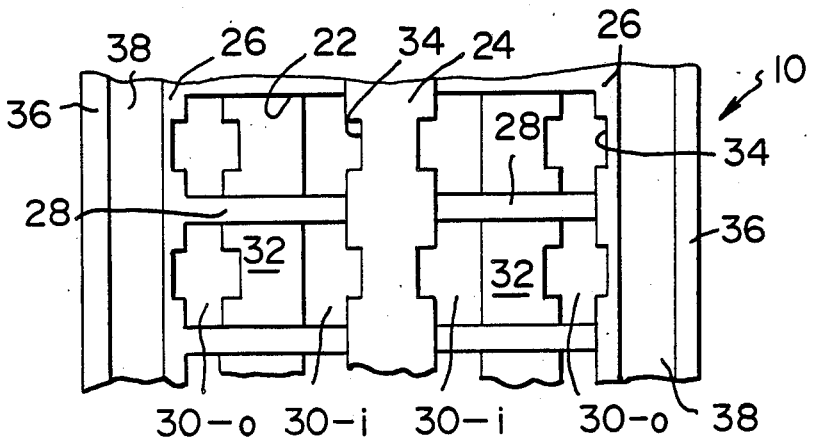
FIG. 2 is a view looking down onto the lower housing.

Lower housing 10 has a plurality of cells 22 spaced down the length of the housing on either side of an upright center wall 24. Inner walls 26, of lesser height relative to the center wall, define the outer extent of the cells. Reference to FIGS. 2 and 6 will show these features clearly. Short, transverse walls 28 separate cells 22 one from the other. Inner and outer passages, 30-i and 30-o respectively extend through the lower housing from floor 32 of the cells downwardly to open out on underside 34. Passages 30-i are adjacent center wall 24 and passages 30-o are adjacent inner walls 26. Both walls 24 and 26 are vertically grooved as indicated by reference numeral 34. These grooves are an upward continuation of the passages.

Side walls 36 of the lower housing are spaced apart from inner walls 26 to define longitudinal slots 38 there between. Several cam followers 40 are positioned in and along the slots.

T-shaped, vertical end walls 42 are provided at the ends of lower housing 10. The upper end of the walls are slotted as indicated by reference numeral 44 and the upper corners are angled as indicated by reference numeral 46.

Lever support member 48 is attached to and extends forwardly from the front end of lower housing 10. Slot 50 extends in and along the top of member 48, intersecting U-shaped, transverse slot 52.

Pin 54 may depend from end walls 42 as shown in phantom in FIG. 5. These pins orientate and stabilize the connector on the circuit board.

Contact elements 12 and 14 are positioned in the cells in lower housing 10 with an upper section or cantilever beam extending upwardly into upper housing 18 (FIGS. 6 and 7), a retaining section in passages 30, and a lower section extending downwardly from the lower housing for insertion into plated-through holes in a circuit board. Each cell accommodates two elements; i.e., one element 12 and one element 14. In FIG. 1, elements are omitted for sake of clarity. Elements 12 are positioned in passages 30-i and accordingly are referred to as the inner elements. Elements 14 are positioned in passages 30-o and are referred to as the outer elements.

The stucture of the elements are shown in FIGS. 3-*a*, 3-*b*, and 4-*a*, 4-*b*. With reference now to the drawings in those figures, 3-*a*, 3-*b* illustrate element 12; i.e., the inner element, and 4-*a*, 4-*b* illustrate element 14; i.e., the outer element. The preferred method of making the elements is by stamping and forming them on a continuous strip as indicated by carrier strip 56. The elements can be stored as strips on reels (not shown) and gang inserted into lower housing 10. Reference numeral 58 indicates the score line for breaking the carrier strip away from the elements after insertion.

With regard to both inner and outer elements, reference numeral 60 indicates the cantilever beam, numeral 62, the retaining section, and numeral 64, the lower section. The free end of the cantilever beam carries contact surface 66 which may be plated with a noble metal and which engages the traces on the card inserted in the connector (FIG. 7). A concavo-convex portion below the contact surface provides camming surface 68 on the convex side.

Retaining section 62 includes plate portion 70 and dimples 72.

Lower section 64 includes a lead 74 for insertion into a plated-through hole in a circuit board. The lead also can be a compliant pin type such as disclosed in U.S. Pat. No. 4,186,982.

Both retaining section 62 and lower section 64 are thicker than upper section 60 to provide support both in the lower housing and in the circuit board. The thinner upper section is required for resiliency.

Contact elements 12 differ from elements 14 in substantially two respects. The concavo-convex portion defining camming surface 68 is horizontally offset relative to the longitudinal axis of element 12. Cantilever beam 60 is attached to the left side of retaining section 62 in element 12 and on the right side in element 14. These differences are required so that the two elements can be loaded in one cell without interference. Other differences such as length exist but are not significant from the viewpoint of crowding a large number of contact elements in a connector.

Cam slides 16, FIG. 1, are elongated members structured to be slidably positioned in slots 38 in lower housing 10. A series of cam ramps 76 are provided along the bottom edge of the slides, these ramps cooperating with cam followers 40 in slots 38 to move the slides vertically as they are being moved horizontally, all in a well-known manner.

A longitudinal groove 78 is provided on the inside surface of the slides adjacent the top edge.

Holes 80 are provided in the front end of the slides to receive pins on the lever shown in FIG. 5.

With reference to FIGS. 1 and 6, upper housing 18 is an elongated member which is attached to lower housing 10 and which is raised and lowered by operation of cam slides 16.

The outer surfaces of sidewalls 82 of the upper housing have lower parallel portions 84 and slanted or converging upper portions 86. L-shaped members 88 depend from the bottom edges of the side walls with the horizontal portion thereof adapted to ride in grooves 78 on cam slides 16.

The inside area of upper housing 18 is divided into cells 90 by a series of transverse, vertical walls 92 which are slotted down the middle to provide a card edge receiving slot 94. These walls help stiffen the side walls of the upper housing against distortion when the contact elements are cammed into and out of engagement with the card. With the components assembled, walls 92 are in alignment with transverse walls 28 in lower housing 10 and cells 90 are in alignment with cells 22.

Transverse, vertical walls 96 extend a short distance into cells 90 from the side walls to provide a barrier between the cantilever beams 60 of adjacent contact elements.

The specific structure of the inside surfaces of sidewalls 82; i.e., the outer wall defining cells 90, can best be seen in the cross-sectional drawing of FIG. 6. The outer wall on each side of a cell, indicated generally by reference numeral 98, have two vertical portions, one on each side of short transverse wall 96. Each cell then has four such portions, two on each side of slot 94. Each vertical portion has a beveled cam surface, indicated by the reference numeral 100. One such cam surface is located either higher or lower on the wall than the adjacent cam surface; i.e., the cam surface on the same wall on that side of the cell. Accordingly, the higher positioned cam surface is further referenced by the addition of letter "h" to the numeral 100; thus 100-h. The lower positioned cam surface is referred to by the letter "l"; thus 100-l.

Facing cam surfaces are unlike; i.e., a high cam surface 100-h looks directly across slot 94 at a low cam surface 100-l.

The openings on the slanted sidewalls are passages made by the core pins in molding the upper housing. FIG. 1 shows one of the two identical, longitudinal ends 102 of upper housing 18. A vertical wall 104 is slotted as a continuation of card edge receiving slot 94. Bracket 106 defines a vertical channel 108 which slidingly receives the upper ends of end walls 42 on lower housing 10.

Lever 110, shown in FIG. 5, has two spaced apart, parallel members 112 joined by pin 114. Further, a pin 116 projects laterally from opposite surfaces of members 112.

In an assembled connector of the present invention, FIGS. 5, 6, and 7, contact elements 12 are positioned in lower housing 10 with the retaining section 62 in inner passage 30-i. The retaining section 62 on contact elements 14 are positioned in outer passage 30-o. Camming surfaces 68 face outwardly and contact surfaces 66 face inwardly on both elements.

Cam slides 16, attached to lever 110 by pins 116 entering holes 80, are attached to upper housing 18 via L-shaped members 88 and grooves 78 and that sub-assembly lowered onto lower housing 10 with the cam slides being received in slots 38 and the upper portions of the T-shaped end walls 42 sliding up into openings 108. Pin 114 slides into transverse slot 52 in lever support member 48.

Upper sections 60 of contact elements 12 and 14 are received in cells 90 as shown in FIG. 6 with contact surfaces 66 facing into slot 94 and camming surfaces 68 facing the outer walls. In the FIG. 6 position, the contact surfaces are within the cell area and the camming surfaces are above cam surfaces 100. The side view seen in FIG. 5 shows slides 16 resting on the floors of slots 38. FIG. 5 also shows the connector, indicated generally by reference numeral 118 positioned on circuit board 120.

As described above and as shown in FIGS. 5 and 6, the contact surfaces 66 on adjacent contact elements 12, 14, on each side of slot 94, are located at alternating upper and lower contact surface positions, and the elements which face one another across the slot, such as elements 12 and 14 in the foreground of FIGS. 5 and 6, are not at the same contact surface position. This permits the connector to be used with cards having rows of alternating upper and lower contact pads, as is described hereinafter.

With the connector in the FIGS. 5 and 6 mode, card 122 may be freely inserted into slot 94. Upon pivoting lever 110 upwardly, cam slides 16 are drawn forwardly and, riding up on cam followers 40, the slides rise vertically and so does upper housing 18. Cam surfaces 100 in cells 90 engage camming surfaces 68 and the contact surfaces 66 are forced inwardly against conductive traces 124 and 126 on card 122. Note that the contact surfaces on contact elements 12 engage the lower traces 126 and the contact surfaces on elements 14 engage higher traces 124.

Card 122 may be withdrawn from the connector by pivoting lever 110 back down to the FIG. 5 position.

What is claimed is:

1. A zero insertion force, card edge connector, adapted to engage the conductive traces on a card inserted in a card receiving slot in the connector, comprising:

a. an elongated lower housing with a base having a plurality of contact receiving passages located on each longitudinal side;

b. an elongated upper housing positioned over the lower housing having a longitudinally extending card receiving slot and cam surfaces facing the slot with said cam surfaces being located at more than one vertical position;

c. cam means positioned between the upper and lower housings for vertically moving the upper housing; and d. contact elements retained in the passages in the lower housing, each element having a cantilevered portion extending into the upper housing between the slot and cam surfaces with a contact surface facing the slot for engagement with a conductive trace on a card inserted in the slot, and a convex surface positioned adjacent a cam surface on the upper housing for engagement with the cam surface during vertical movement of the upper housing to move the contact surface into engagement with a trace on a card positioned in the slot, the cantilevered portions of the elements on each side of the slot being longitudinally spaced from each other, the elements being arranged in opposing pairs whose contact surfaces face one another across the slot, the contact surfaces on adjacent elements along each side of the slot being located at different vertical positions, and the facing contact surfaces on elements located on opposite sides of the slot being located at different vertical positions and further with all elements having contact surfaces at each vertical position having their associated cam surfaces located at one vertical position.

2. The card edge connector of claim 1, wherein the different vertical positions of the contact surfaces comprise alternating upper and lower contact positions.

3. The card edge connector of claim 2, wherein the cam surfaces for elements with contact surfaces at the upper contact position are at a first vertical position and the cam surfaces for elements with contact surfaces at the lower contact position are at a second, lower vertical position.

4. The card edge connector of claim 3, wherein the first vertical cam surface position is above the bottom of the card receiving slot and wherein at least a portion of the second vertical cam surface position is below the bottom of the card receiving slot.

5. The card edge connector of claim 3, wherein there is an individual cam surface for each element.

6. The card edge connector of claim 3, wherein the upper housing is divided into a plurality of cells by a series of transverse vertical walls which extend between the longitudinal side walls of the upper housing, each of said transverse walls having a slot which forms a portion of the card receiving slot.

7. The card edge connector of claim 6, wherein each cell encloses the cantilevered portions of two contact elements on each side of the card slot and wherein said cantilevered portions are separated from each other by vertical barrier walls.

8. The card edge connector of claim 3, wherein the elements are of two different configurations, one for elements with contact surfaces at the upper position and the other for elements with contact surfaces at the lower position.

9. A zero insertion force, card edge connector adapted to engage the conductive traces on a card inserted into a card receiving slot in the connector, comprising:

a. an elongated lower housing having a base with a plurality of contact receiving passages therethrough located along each side of the longitudinal axis of the lower housing;

b. an elongated upper housing positioned over the lower housing having a card receiving slot extending along the longitudinal axis of the upper housing and a plurality of cam surfaces facing the slot along the inside of the longitudinal side walls of the upper housing, the adjacent cam surfaces along each side wall being located at alternating upper and lower positions with the cam surfaces facing one another across the slot being located at different vertical positions;

c. cam means positioned between the upper and lower housings for vertically moving the upper housing; and d. contact elements retained in the passages in the lower housing, each element having a cantilevered portion extending into the upper housing with a contact surface facing the slot for engagement with a conductive trace on a card inserted in the slot and a convex surface positioned adjacent a cam surface on the upper housing for engagement with the cam surface during vertical movement of the upper housing to move the contact surface into and out of engagement with a trace on a card positioned in the slot, the cantilevered portions of the elements on each side of the slot being longitudinally spaced from each other, the elements being arranged in opposing pairs whose contact surfaces face one another across the slot, the contact surfaces on adjacent elements along each side of the slot being located at alternating upper and lower positions and the facing contact surfaces on elements located on opposite sides of the slot being located at different vertical positions.

10. The card edge connector of claim 9, wherein the convex surfaces of elements with upper position contact surfaces are positioned adjacent upper position cam surfaces and wherein the convex surfaces of elements with lower position contact surfaces are positioned adjacent lower position cam surfaces.

11. The card edge connector of claim 10, wherein the upper housing is divided into a plurality of cells by a series of transverse vertical walls which extend between the longitudinal side walls of the upper housing, said transverse walls being provided with a slot which forms a portion of the card receiving slot.

12. The card edge connector of claim 11, wherein the upper cam surface position is above the bottom edge of the card receiving slot and wherein at least a portion of the lower cam surface position is below the bottom edge of the card receiving slot.

13. The card edge connector of claim 11, wherein each cell encloses the cantilevered portion of two contact elements on each side of the card receiving slot.

14. The card edge connector of claim 13, wherein the two contact elements on each side of a cell are separated from each other by a vertical barrier wall.

15. The card edge connector of claim 11, wherein the contact receiving passages located along each side of the longitudinal axis of the lower housing comprise a series of inner and outer tandem passages.

16. The card edge connector of claim 11, wherein the elements are of two different configurations, one for elements with contact surfaces at the upper portion and the other for elements with contact surfaces at the lower position.

17. A zero insertion force, card edge connector, adapted to engage the conductive traces on a card inserted in a card receiving slot in the connector, comprising:

a. an elongated base having a plurality of contact receiving channels located along each longitudinal side;

b. an elongated movable member positioned over the base having a longitudinally extending card receiving slot and a plurality of cam surfaces spaced along both sides of the slots and wherein the adjacent cam surfaces along each side of the movable member are located at alternating upper and lower positions, with the cam surfaces located across the slot from one another being at different vertical positions, c. cam means positioned between the base and the movable member for vertically moving the movable member; and d. contact elements located in the channels on the base, each element having a cantilevered portion extending above the base between the slot and cam surfaces with a contact surface facing the slot for engagement with a conductive trace on a card inserted in the slot and a cam surface positioned adjacent a cam surface on the movable member for engagement with said cam surface during vertical movement of the movable member to move the contact surface into and out of engagement with a trace on a card positioned in the slot, the cantilevered portions of the elements on each side of the slot being longitudinally spaced from each other, the elements being arranged in longitudinally spaced-apart opposing pairs whose contact surfaces face one another across the slot, the contact surfaces on the adjacent spaced-apart elements along each side of the slot being located at alternating upper and lower positions and the facing contact surfaces on elements located on opposite sides of the slot being located at different vertical positions.

18. The card edge connector of claim 17, wherein the cam surfaces for elements with contact surfaces at the upper contact position are at the upper cam surface position and wherein the cam surfaces for elements with contact surfaces at the lower contact position are at the lower cam surface position.

19. The card edge connector of claim 18, wherein the upper and lower contact surface positions are aligned with alternating upper and lower traces on the card to be inserted into the slot.

20. The card edge connector of claim 17, wherein the movable member has a transverse wall between adjacent elements.

21. The card edge connector of claim 20, wherein the transverse walls are located between the adjacent cam surfaces.

22. The card edge connector of claim 17, wherein the elements are of two different configurations, one for elements with contact surfaces at the upper position and the other for elements with contact surfaces at the lower position.

23. A cam actuated, zero insertion force, card edge connector having a plurality of contact elements adapted to engage the conductive traces on a card inserted in a card receiving slot in the connector, the contact elements along each side of the slot having longitudinally spaced-apart cantilevered beams including a contact surface to engage a conductive trace on a card inserted into the connector and a cam surface for engagement with cam surfaces located on a movable cam member positioned on each side of said slot with said cantilever beams located therebetween, the improvement comprising:

cam surfaces along each movable cam member being located at alternating upper and lower positions and with the cam surfaces on the cam member on one side of the slot being located at a different vertical position relative to the facing cam surfaces on the cam member on the other side of the slot; and contact elements whose cantilevered beams have contact surfaces at different vertical positions both with respect to adjacent beams along each side of the slot and to beams facing each other across the slot.

24. The card edge connector of claim 23, wherein the cam surfaces on a movable cam member for elements with contact surfaces at an upper contact position are at the upper position and wherein the cam surfaces on a movable cam member for elements with contact surfaces at a lower contact position are at the lower position.

25. The connector of claim 24 wherein the cam surfaces on the contact elements are located at more than one vertical position, with all elements having contact surfaces at each vertical position having their associated cam surfaces located at one vertical position.

26. The connector of claim 25 wherein the different vertical positions of the contact surfaces comprise alternating upper and lower contact positions.

27. The connector of claim 26 wherein there is an individual cam surface for each element.

* * * * *